United States Patent [19]

Fassman et al.

[11] 4,168,057

[45] Sep. 18, 1979

[54] ROTARY COLLATOR WITH SHEET CLAMP ACTUATOR

[75] Inventors: Arnold Fassman, Westport; Lloyd G. Kittredge, Trumbull; Thomas L. Simmel, Milford, all of Conn.

[73] Assignee: Pitney-Bowes, Inc., Stamford, Conn.

[21] Appl. No.: 908,717

[22] Filed: May 23, 1978

[51] Int. Cl.[2] ..... B65H 39/045

[52] U.S. Cl. ..... 270/58

[58] Field of Search ..... 270/58

[56] References Cited

U.S. PATENT DOCUMENTS

| | | | |
|---|---|---|---|
| 2,940,750 | 6/1960 | Mestre | 270/58 |
| 3,796,422 | 3/1974 | Blowsky | 270/58 |

*Primary Examiner*—Edgar S. Burr
*Assistant Examiner*—A. Heinz
*Attorney, Agent, or Firm*—Martin D. Wittstein; William D. Soltow, Jr.; Albert W. Scribner

[57] ABSTRACT

A rotary collator having a rotatable drum with a plurality of radially extending partitions or bins in which sheets to be collated are held by a sheet clamp mounted in each bin. The sheet clamp for each bin has a solenoid-based activating device which releases the sheet clamp during the sheet ejecting portion of the collating cycle. The sheet clamp is released a short time before the rotatable drum brings the associated bin into a sheet ejecting position. A toggle structure and a relatively high compression spring are used to hold the sheets in the bin when in clamping position. The sheet clamp of any empty bin is programmed not to release, thereby greatly reducing noise and extending the life of the mechanism.

6 Claims, 5 Drawing Figures

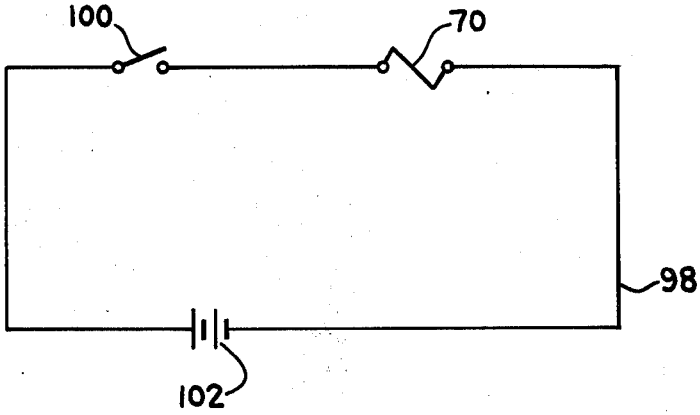
FIG. 4
FIG. 5
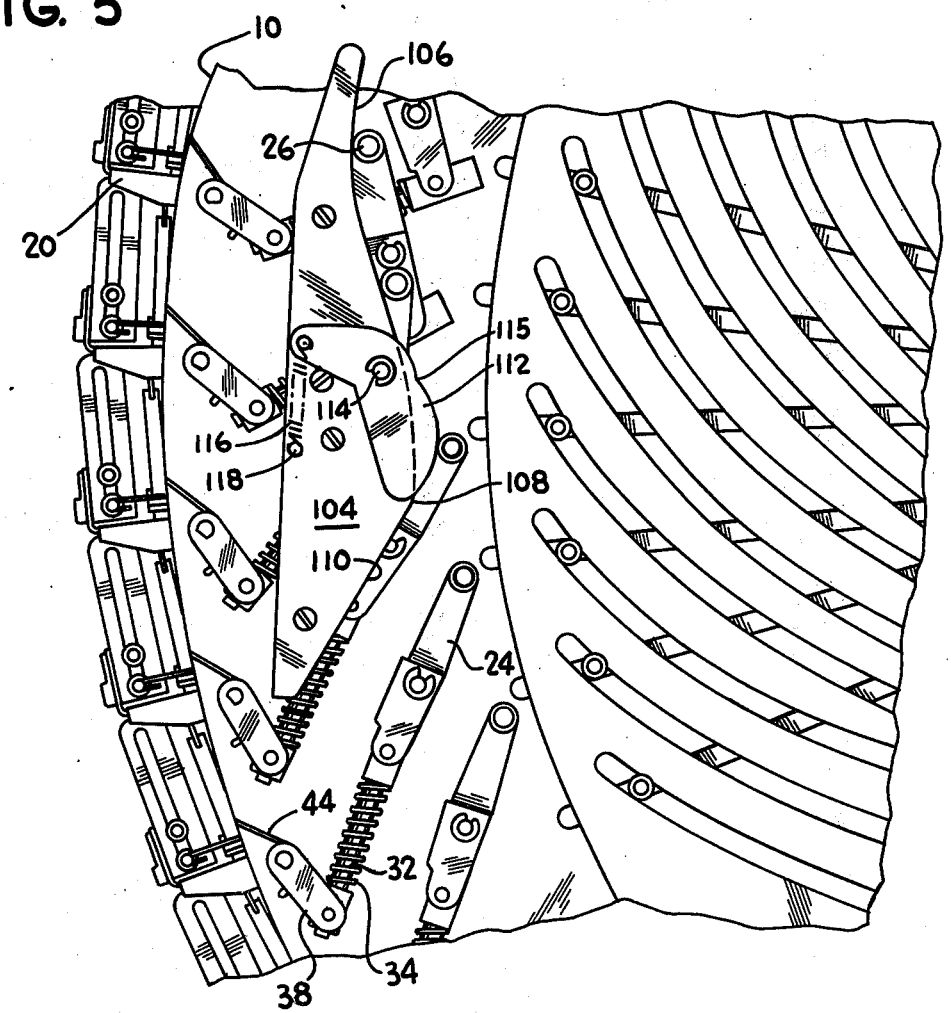

ROTARY COLLATOR WITH SHEET CLAMP ACTUATOR

BACKGROUND OF THE INVENTION

1. Field of the Invention

The present invention relates, in general, to a handling device and, more particularly, to an electrically powered rotary collator which collates sheets.

Rotary collators use a rotating drum with radially extending partitions which divide the drum into radially extending bins. Each successive bin may be loaded with a plurality of sheets of successive pages of a booklet to be collated. Some of the bins may be empty. As the drum rotates, the pile of sheets in each loaded bin is held against its bin by a sheet clamp except at a sheet ejecting position or a region thereof when the stack of sheets must be released or unclamped so that the top sheet can be withdrawn from the bin. A sheet from each of the loaded bins is withdrawn and the sheets are assembled together in sequence so that they may be stapled or otherwise bound together.

After each bin passes the sheet ejecting position, the sheet clamp is operated to clamping position by an activating device that uses a toggle structure. In known machines, the sheet clamp held against each bin is released when the bin reaches its ejecting position and is clamped again soon after the bin moves beyond its ejecting position. In these previous systems, the clamping/unclamping procedure takes place on each bin irrespective of whether sheets are loaded in the particular bin in question.

The clamping springs used are strong enough to hold thick stacks of sheets against the partition side. Consequently, the cumulative effect of the noise generated by released sheet clamps slamming shut against empty bins is significant in these previous system. In addition, individual elements of the mechanism are subject to wear, despite the fact that their functions are not always required.

2. Description of the Prior Art

U.S. Pat. No. 2,936,168 teaches the use of a rotating drum with radially extending partitions. No provision is made therein for programmably disabling sheet clamps which are not required during the collating operation. U.S. Pat. No. 3,970,297 shows and describes apparatus for withdrawing a single top sheet from each bin as the bin reaches the ejecting position in the collator cycle. The sheet withdrawing invention described in the above patent can be used in conjunction with the present invention, as hereinafter disclosed.

U.S. Pat. No. 3,796,422 teaches the use of a sheet clamp release activating device which uses a toggle structure. The activating device of that invention is actuated each time a bin approaches its ejecting position, regardless of whether the bin contains sheets. The resulting objectionable noise and wear of parts are significant in that system.

Accordingly, the present invention now reduces the noise associated with sheet clamping operations of a rotary collator. Only those sheet clamps which must be released, or opened, during the eject cycle of their corresponding bins are specified in advance. Certain bins which are either empty or loaded with unwanted sheets now remain intact in a closed position at all times during the collating cycle. The life expectancy of mechanical elements is extended by reducing wear on those clamp mechanisms associated with empty or unused bins. The total amount of energy expended for a normal collating project is also reduced by the present invention by activating less than all mechanisms during each sheet ejecting cycle.

SUMMARY OF THE INVENTION

Briefly, the sheet clamp actuator of the present invention is for use in a rotary collator in which sheets are stacked in collator bins. The present invention includes an electromechanical solenoid connected to a suitable power supply. An extension bar is pivotably connected to the solenoid at one end, and pivotably connected to an interposer link at the other end. The interposer link has a protuberance which fits into the detent of a switching cam. The switching cam is capable of movement into the path of sheet clamps as the collator drum rotates, thus causing the individual sheet clamps to release during a specified portion of the collating cycle. Once the sheet clamps are in a release position, sheets may be removed from their collator bins. Upon passing the point in the collator cycle at which the sheet clamp actuator interacts with the sheet clamp, the clamp returns to its normally closed position, thus retaining the stacks of sheets in their bins for the major portion of the collating cycle.

From the foregoing discussion it is clear that an object of the present invention is to provide an improvement of a rotary collator.

Another object of the present invention is to provide a sheet clamp actuator to release only specified sheet clamps during the collating cycle.

A further object of the present invention is to reduce the general operating noise associated with a rotary collator.

Yet another object of the present invention is to reduce energy consumption of a rotary collator when operating with less than all bins containing sheets.

Still another object of the present invention is to extend the life expectancy of sheet clamps by not actuating them when not in use.

BRIEF DESCRIPTION OF THE DRAWINGS

The novel features which are characteristic of the present invention are set forth with particularity in the claims, but the invention will be understood more clearly and fully from the following detailed description of a preferred embodiment thereof, as set forth in connection with the accompanying drawings in which:

FIG. 4 is a simplified electrical circuit for energizing solenoid.

FIG. 5 is a partial view of the collator drum and sheet clamps in relation to the sheet clamp closing means.

DESCRIPTION OF THE PREFERRED EMBODIMENT

Figure 1:
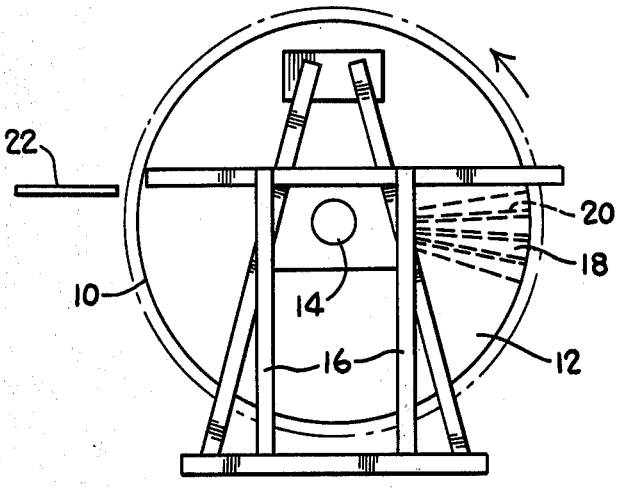
FIG. 1 is a diagrammatic view of a rotary collator.

Referring now to the drawings wherein a preferred embodiment of the invention is illustrated, FIG. 1 discloses a rotary collator apparatus. The rotary collator includes a drum 10 having spaced side plates 12 which drum is mounted for rotation on an axle or shaft 14 carried by a suitable frame 16. The drum 10 is divided into a plurality of bins 18 by a plurality of spaced radially or substantially radially extending partitions 20 which are suitably secured to the spaced side plates 12. Each partition 20 forms a bin 18 for a stack of sheets, not shown. Suitable ejecting means, not shown, ejects the top sheet from the stack of sheets and delivers it to a receiving or transfer table 22 which establishes the ejecting position for each bin 18. In the rotary collator, each stack of sheets is disposed in generally horizontal position, resting on its partition 20 as it passes through the sheet ejecting position. As the drum 10 turns, the partitions 20 become disposed vertically with respect to the ground at the top and at the bottom of the drum 10. Clamping means, described in more detail hereinafter, are provided to retain each stack of sheets against its associated partition 20 through all or the major portion of the rotation of the drum 10 except for the sheet ejecting position and preferably shortly thereafter as will be further described hereinafter.

Figure 2:
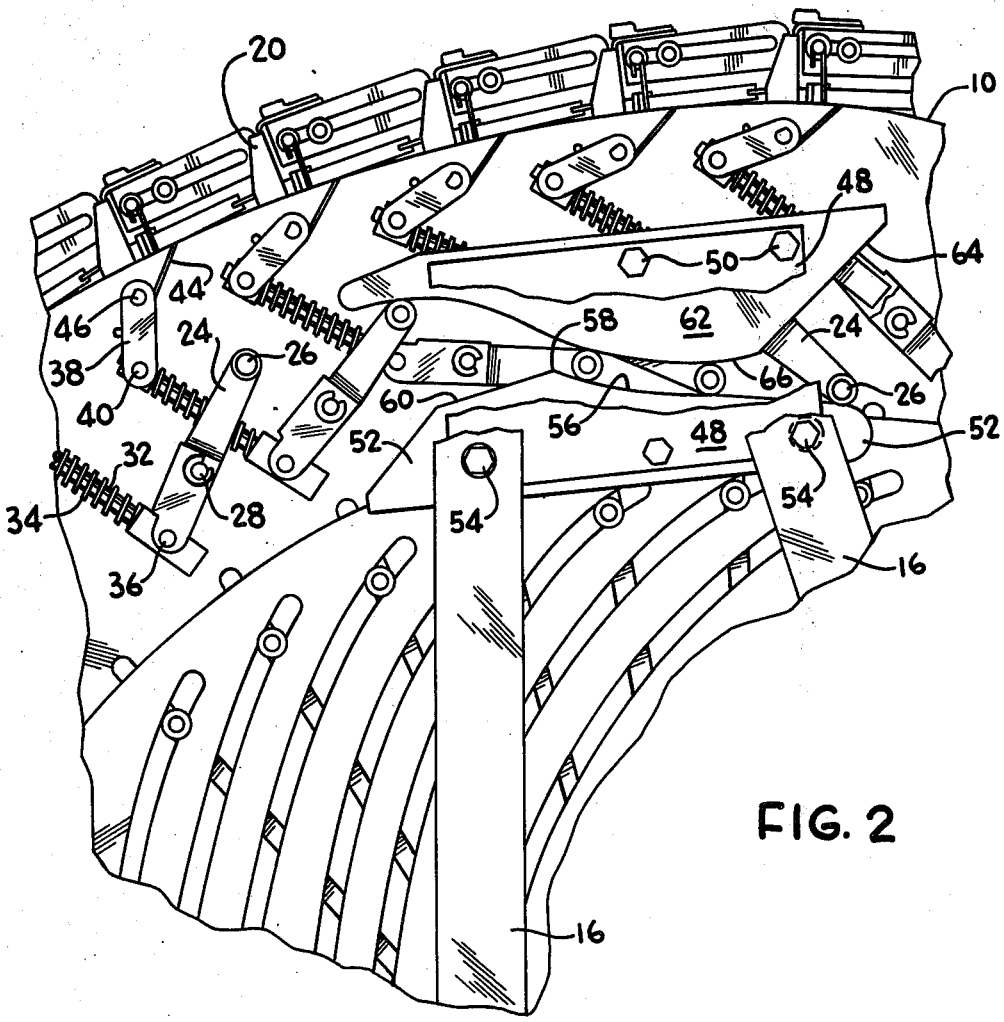
FIG. 2 is a partial view of the collator drum and sheet clamps in relation to the sheet clamp opening path.
Figure 3:
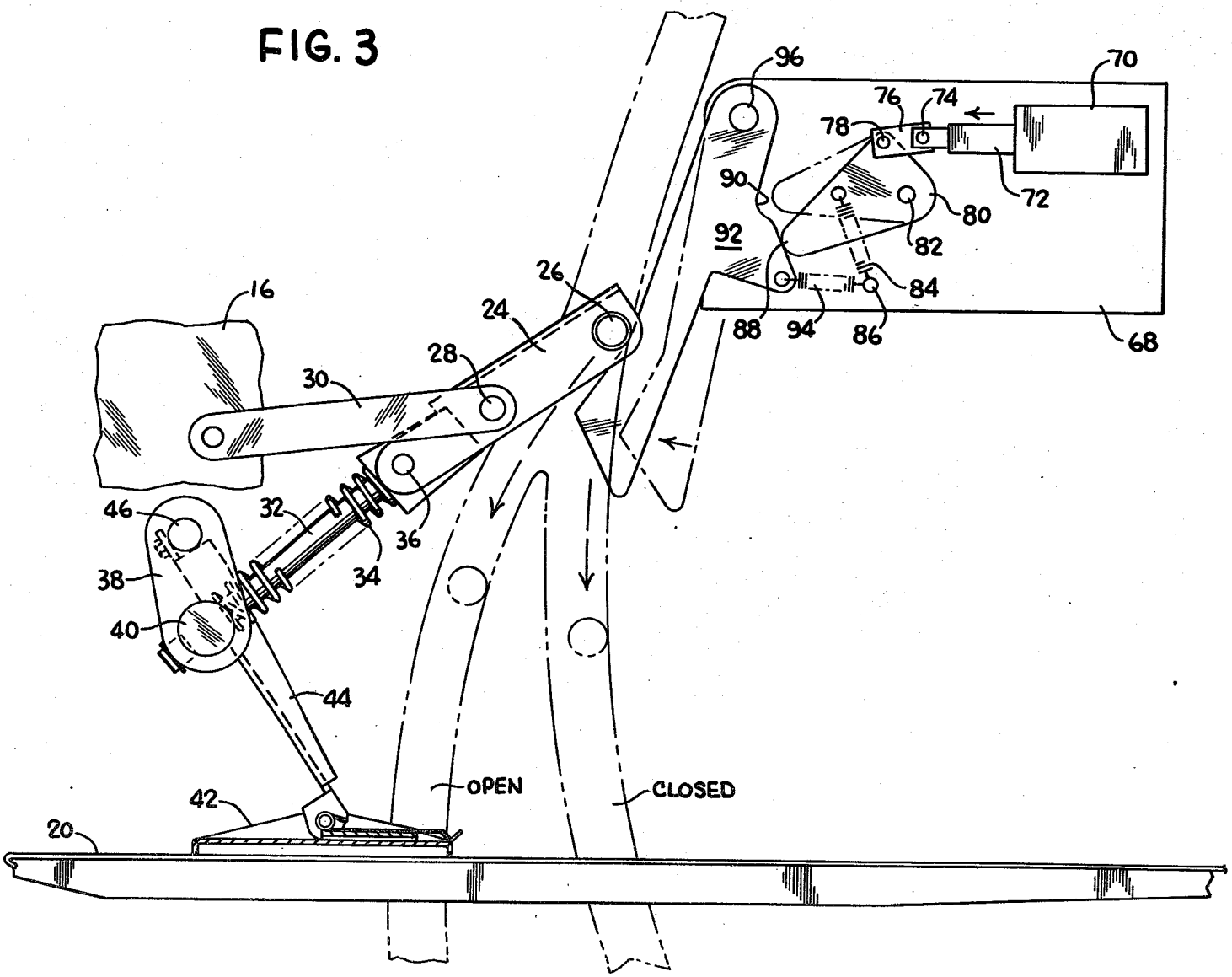
FIG. 3 is a detailed view of a sheet clamp and the sheet clamp actuator.

Referring now to FIGS. 2 and 3, reference numeral 24 denotes a toggle extension. A cam follower 26 is suitably mounted on the toggle extension 24. The toggle extension 24 is rotatably mounted at a support pivot 28 to the revolving drum 10 by a supporting member 30. A shaft 32 inserted in a compression spring 34 connects the toggle extension 24 at a connection pivot 36 to a pivotable link 38 at a lower connecting pivot 40. The compression spring 34 is a spring with flat ends abutting their respective surface. The pivotable link 38 is connected to a clamp 42 by a clamp plate 44, which is connected to the pivotable link at an upper fixed pivot 46. The upper fixed pivot 46 is attached to the revolving drum 10. The clamp 42 normally rests on a partition 20 or on a stack of sheets loaded on said partition. The partition 20 is itself mounted on and part of the revolving drum 10.

The compression spring 34 has a length such that its pressure on the toggle extension 24 ceases or is light when the toggle is fully open. When the clamp 42 is closed on a stack of sheets or against the partition 20, the toggle extension 24 is in locked position with the connection pivot 36 past (above) a line between the centers of the pivots 28 and 40.

When a thick stack of sheets rests on a partition 20, the compression spring 34 is at its maximum compression. Since usually the stack is half or less of capacity, this means that most of the time this compression spring 34 is operating in its area of less or minimum compression. The compression spring 34 is strong enough to hold the stack of sheets against its partition 20 without slippage in all positions of the latter. The compression spring 34 also accommodates for the varying thickness of the stack of sheets.

Cam means for maintaining an open clamp position, when required, is located adjacent to the top of the drum 10 and is carried by frame members 16. A cam mounting plate 48, forming a part of the frame 16, is secured to the frame by bolts 50. An opening cam 52 is attached to the cam mounting plate 48 by bolts 54. This opening cam 52 has a rising surface 56 part of which may be arcuate and which is engaged by selected cam followers 26 as the drum 10 rotates and opens the toggle extension 24. This rising surface 56 comes to a peak 58 after which the surface of the opening cam 52 drops away in angular portion 60. The contoured angle portion 60 of the opening cam 52 is provided to guide the cam follower 26 past the cam if the drum 10 is reverse rotated.

A restraining cam 62 is provided adjacent to the opening cam 52. A sharply angled clamp closing portion 64 is provided as a first part of the surface of the restraining cam 62 so that if a clamp 42 is open for any reason, the cam follower 26 engages this portion and closes the clamp. The restraining cam 62 then has a restraining portion 66 parallel to and spaced from the opening cam 52 by the diameter of the cam follower 26 to the peak 58 after which the surface of the restraining cam surface continues gradually outwardly to restrain any rapid opening of the clamp 42. Finally the restraining cam 62 levels out as the clamp 42 approaches full open position with the compression of the compression spring 34 largely or perhaps entirely dissipated. The clamp 42 is in full open position at least as the partition 20 nears sheet ejecting position.

Referring now again to FIG. 3, reference numeral 68 denotes generally an activating mechanism for switching the toggle extension 24 from one position (hereinafter the open position) to another position (hereinafter the closed position) constructed in accordance with the invention. A solenoid 70 is mounted on the non-revolving collator frame 16 shown in FIG. 1. The plunger 72 of the solenoid 70 is pivotably connected by means of a pin 74 to an extension bar 76 which is pivotably connected by means of a pin 78 to an interposer link 80. The interposer link 80 is pivotably mounted on the fixed collator frame 16 by means of a pin 82 located below the pivot pin 78.

One end of a tension spring 84 is connected to the interposer link 80 and the other end is attached to a point 86 on the fixed collator frame 16. The interposer link 80 has a protuberance 88 which fits and locks into a detent 90 of a switching cam 92. From the point 86 at which the first tension spring 84 is connected to the interposer link 80, another tension spring 94 is connected to the switching cam 92. The switching cam 92 is pivotably mounted by pin 96 to the fixed collator frame 16.

Referring now to FIG. 4, a schematic electrical circuit is shown generally at 98 and is constructed in accordance with the invention. The solenoid 70 is in electrical series with an electrical switch 100 and a power source 102.

Referring now to FIG. 5, reference numeral 104 denotes a closing cam. This closing cam 104 has a contoured rising surface 106 which is engaged by selected cam followers 26 as the drum 10 rotates and closes the toggle extension 24. This rising surface 106 comes to a peak 108 after which the surface of the closing cam 104 drops away in angular portion 110. The angular portion 110 of the closing cam 104 is provided to guide the cam follower 26 past the cam if the drum 10 is reverse rotated.

In operation, the electrical switch 100 is enabled during the sheet ejecting portion of the collating cycle and completes the electrical circuit 98, energizing the solenoid 70. When the solenoid 70 is energized, its plunger 72 holds the extension bar 76 back. The interposer link 80 remains in a clockwise orientation on its pin 82, overcoming the tension spring 84 attached to it. The protuberance 88 of the interposer link 80 is seated in the detent 92 of the switching cam 90. In this position, the switching cam 90 is restrained by the tension spring 94 attached to it, and is not brought into contact with the cam follower 26 mounted on the toggle extension 24 as the follower moves in its trajectory past the cam. The cam follower 26 moves along the lower path of the opening cam 52. Consequently, none of the members connected to the toggle extension 24—including the shaft 32 and compression spring 34, the pivotable link 38, the clamp plate 44, and the clamp 42—is moved from its normal position. The clamp 42 is pressed against its partition 20 during all portions of the collating cycle including the sheet ejecting portion, when power is applied to the solenoid 70.

Means are provided for synchronizing completion of the electrical circuit 98 with the revolving collator drum 10, such that at a specified time in the sheet ejecting cycle, power is applied to the activating mechanism 68, causing the clamp 42 to remain closed. Details of this synchronizing means are not required to understand the operation of the activating mechanism 68.

If sheets are to be removed from a specific bin 18 during the sheet ejecting portion of the collating cycle, the electrical switch 100 is disabled, breaking the electrical circuit 98, deenergizing the solenoid 70. When power is removed from the solenoid 70, its plunger 72 is extended, driving the extension bar 74 forward. The interposer link 80 is forced to move in a counter-clockwise direction on its pin 82, aided by the tensile force of the tension spring 84 attached to it. The protuberance 88 of the interposer link 80 moves down and out of the detent 92 in the switching cam 90. In this position, when the interposer link 80 presses into the lower portion of the switching cam 90, the cam is forced to move around its pivot 96 in a clockwise direction. The lower portion of the switching cam 90 moves into the trajectory of the cam follower 26, forcing the toggle extension 24 up. The upper portion of the toggle extension 24 is driven in a counter-clockwise direction around its support pivot 28. The cam follower 26 is guided along the upper path 56 of the opening cam 52, which forces the toggle extension 24 even further into a counter-clockwise position. When the cam follower 26 reaches the peak 58 of the opening cam 52, the toggle extension 24 has been broken from locked position so that the compression spring 34 takes over to continue the opening of the toggle extension 24 until the spring has reached an expansion of reduced compression to open the clamp 42.

The lower portion of the toggle extension 24 moves counter-clockwise about its support pivot 28, increasing the distance between pivots 28 and 40. A tensile force is generated along the compression spring 34, tending to pull the pivotable link 38 in a counter-clockwise direction about its upper fixed pivot 46. The upper fixed pivot 46 is fixed to the clamp plate 44, so a counter-clockwise movement of the pivotable link 38 causes the clamp plate 44 and the clamp 42 attached to it to swing up off the partition 20 also in a counter-clockwise direction, generally towards the center of the collator drum 10. In this released position, a sheet can be withdrawn from a stack of sheets, if present, which rests on the partition 20.

After the partition 20 has passed sheet ejecting position and a sheet has been ejected and withdrawn from the bin 18, the closing cam 104 is engaged by the cam follower 26 to close the clamp 42. Preferably the clamp 42 is closed a short distance after passing ejecting position so that if the second sheet has been partially projected outwardly it can be pushed back before the clamp is fully closed.

The closing cam 104 is located approximately on a horizontal line through the center of the drum 10. The closing cam 104 begins with a surface 106 generally rising inwardly until the clamp 42 is practically closed. At this point a spring pressed cam 112 moves the toggle extension 24 to locked position. The spring pressed cam 112 is pivoted on a pin 114 and has a curved surface 115 extending inwardly to engage the cam followers 26 and complete the closing of the toggle extension 24 to locked position. The spring pressed cam 112 is propelled radially inwardly by a spring 116, one end of which is fixed to a pin 118 on the closing cam 104. The spring pressed cam 112 provides assurance that the toggle extension 24 is closed. The clamp 42 remains in this closed position until the collating drum 10 is again rotated to a position where the cam follower 26 is brought into contact with the switching cam 92.

Should the clamp 42 be jammed for any reason, the compression spring 34 yields and if the toggle extension 24 should jam, the spring pressed cam 112 yields and in this manner protects the clamp 42 and the associated mechanism from being damaged. The angular portion 110 of the closing cam 104 continues radially outwardly so that it engages the cam follower 26 in the event that the drum 10 is reverse rotated.

Preferably the clamp 42 is opened about six bins 18 before sheet ejecting position so the bins can be loaded with sheets in this quadrant of drum 10 rotation when the clamps 42 are open. A sheet backstop, not shown, provided in the bins 18 retains the sheets undisturbed in their bin and on their partition 20.

The synchronizing means, now shown, coordinates disabling of the electrical switch 100 with the drum 10 rotation. The solenoid 70 is re-energized and all elements of the activating mechanism 68 return to their initial closed positions.

This invention is presented to fill a need for improvement in a rotary collator with sheet clamp actuator. It is understood that various modifications in structure, as well as changes in mode of operation, assembly and manner of use, may and often do occur to those skilled in the art, especially after benefitting from the teachings of an invention. This disclosure illustrates the preferred means of embodying the invention in useful form.

What is claimed is:

1. In a sheet collator having a rotatably mounted drum having a plurality of radially opening sheet holding bins defined by a plurality of partitions, means for with drawing sheets from said bins at a withdrawing position, a sheet clamping assembly associated with each of said bins and having a sheet clamp movable in said bin between a closed and an open position with respect to one of said partitions defining said bin to normally retain sheets in the bin when the bin is in a position other than said sheet withdrawing position during rotation of said drum, and means normally moving said clamps between said closed and open positions during rotation of said drum, the improvement comprising: actuator means operatively associated with said moving means for selectively disabling said moving means from moving a particular one or more of said clamps from said closed position to said open position during said sheet withdrawing position of said drum, whereby clamps associated with empty or unused partitions can be selectively held in said closed position to prevent noise and wear and tear within said collator.

2. The apparatus of claim 1, wherein said actuator means comprises camming means for camming said sheet clamps between said respective closed and open positions.

3. The apparatus of claim 2, wherein said actuator means further comprises a solenoid actuated linkage connected to said camming means for selectively actuating said camming means.

4. The apparatus of claim 1, wherein said actuator means is operatively connected to a cam to selectively direct said moving sheet clamps from a normal sheet retaining path to a sheet releasing path during said sheet withdrawing position during rotation of said drum, whereby a sheet clamp associated with an empty or unused partition can be selectively held in a sheet retaining position to prevent noise and wear and tear upon one of its respective partitions.

5. The apparatus of claim 4, wherein said actuator means comprises a cam disposed in a path of travel of each of said sheet clamps, said cam being movable between a first position and a second position, said first position allowing each selected sheet clamp to move along said sheet retaining path, and said second position allowing each selected sheet clamp to move along said sheet releasing path.

6. The apparatus of claim 5, wherein said actuator means further comprises a solenoid actuated linkage connected to said cam for selectively moving said cam between its first position and its second position.

* * * * *